US010316573B2

(12) United States Patent
Green et al.

(10) Patent No.: US 10,316,573 B2
(45) Date of Patent: Jun. 11, 2019

(54) MODULAR VAULT ASSEMBLY

(71) Applicant: MDC Industria De Conteineres Inteligentes Ltda., Manaus-AM (BR)

(72) Inventors: Marc Green, Miami Beach, FL (US); Yoram Yaeli, Manaus Am Cep (BR)

(73) Assignee: MDC Industria De Conteineres Inteligentes Ltda., Manaus-Am (BR)

( * ) Notice: Subject to any disclaimer, the term of this patent is extended or adjusted under 35 U.S.C. 154(b) by 56 days.

(21) Appl. No.: 15/602,507

(22) Filed: May 23, 2017

(65) Prior Publication Data

US 2017/0356232 A1 Dec. 14, 2017

Related U.S. Application Data

(60) Provisional application No. 62/341,915, filed on May 26, 2016.

(51) Int. Cl.

| | |
|---|---|
| ***E05G 1/08*** | (2006.01) |
| ***E05G 1/024*** | (2006.01) |
| ***E05G 1/10*** | (2006.01) |
| ***E05B 65/00*** | (2006.01) |
| ***E05G 1/026*** | (2006.01) |

(Continued)

(52) U.S. Cl.

CPC ..... *E05G 1/08* (2013.01); *E05B 65/0075* (2013.01); *E05G 1/024* (2013.01); *E05G 1/026* (2013.01); *E05G 1/04* (2013.01); *E05G 1/10* (2013.01); *E05B 2047/0067* (2013.01); *E05B 2047/0069* (2013.01)

(58) Field of Classification Search

CPC .. E05G 1/00; E05G 1/02; E05G 1/024; E05G 1/06; E05G 1/08

See application file for complete search history.

(56) References Cited

U.S. PATENT DOCUMENTS 5,219,386 A * 6/1993 Kletzmaier ..... E05B 17/147 70/277
5,504,325 A * 4/1996 Talmon ..... G07F 17/12 109/56
5,862,693 A 1/1999 Myers et al.

(Continued)

FOREIGN PATENT DOCUMENTS

WO 2017208077 A2 12/2017

*Primary Examiner* — Christopher J Boswell

(74) *Attorney, Agent, or Firm* — Malloy & Malloy, PA

(57) ABSTRACT

A modular vault assembly including a plurality of vault modules variable in number and including a primary vault and one or more secondary vaults. The secondary vaults are interconnected in successively adjacent relation and a leading secondary vault is connected adjacent to the primary vault. The primary vault and each of the secondary vaults respectively include a master door and a slave door having a locking mechanism disposable in a locked and unlocked orientation. The locking mechanism of the leading secondary vault is manually positioned in the unlocked orientation from an interior of said primary vault and each of said locking mechanisms of a remainder of the secondary vaults is manually positioned, successively, in the unlocked orientation from an interior of a preceding, next adjacent one of the plurality of secondary vaults. Each master and slave door includes a sensor assembly indicating the locked orientation of a corresponding locking mechanism.

33 Claims, 10 Drawing Sheets

(51) Int. Cl.
*E05G 1/04* (2006.01)
*E05B 47/00* (2006.01)

(56) References Cited

U.S. PATENT DOCUMENTS

| | | | | |
|---|---|---|---|---|
| 6,499,817 | B2 * | 12/2002 | Jermain | G07F 9/06 312/257.1 |
| 6,786,009 | B1 * | 9/2004 | McGunn | A47B 47/03 312/263 |
| 7,854,374 | B2 | 12/2010 | Dudley | |
| 9,405,038 | B2 * | 8/2016 | Knight | B65B 25/02 |
| 9,562,386 | B2 * | 2/2017 | Berman | E05G 1/024 |
| 9,663,974 | B2 * | 5/2017 | Savage | E05B 47/0603 |
| 2005/0104730 | A1 | 5/2005 | Yang | |
| 2010/0063621 | A1 | 3/2010 | Pelletier | |
| 2015/0356801 | A1 | 12/2015 | Nitu et al. | |
| 2016/0136997 | A1 * | 5/2016 | Polad | B60B 33/0086 188/1.12 |
| 2018/0058133 | A1 * | 3/2018 | Kay | E05G 1/024 |

* cited by examiner

MODULAR VAULT ASSEMBLY

CLAIM OF PRIORITY

The present application is based on and a claim of priority is made under 35 U.S.C. Section 119(e) to a provisional patent application that is currently in the U.S. Patent and Trademark Office, namely, that having Ser. No. 62/341,915 and a filing date of May 26, 2016, and which is incorporated herein by reference.

BACKGROUND OF THE INVENTION

Field of the Invention

The present invention relates to safes, vaults and armored cabinets, and, in particular, to a modular vault assembly, which have several vault modules including interior storage compartments and/or enclosures which are connected to one another in a successively adjacent array. Specifically, the present invention relates to the overall structure, components and methods which enable the simplification of logistics and installation, and prevent or significantly restrict a break-in or other unauthorized entry on the connection joints and overall structure of the individual vault modules.

Description of the Related Art

Vaults, safes and like structures are utilized in a variety of applications and environments to provide protection and safekeeping for different categories of valuables. In addition to conventional valuables such as money, jewelry, etc. it is common practice to provide protective structures for a variety of larger items including confidential records, documents, computers and similar equipment.

It is generally well known that conventional vaults, safes, etc. are manufactured and constructed from materials such as steel or other metals as well as concrete and various types of construction materials selected because of their strength and resistance to access, such as by different types of tools and/or equipment. However, protective structures utilizing this type of construction are heavy, cumbersome and are sometimes integrated into the construction of a building in which they are located. In addition, traditional safes and vaults are designed with minimal joints and moving parts.

As used in many practical applications such as banks, a typical vault or safe will have a single solid body and a single non-removable door. Such a construction maximizes the security of the structure, but includes certain disadvantages. Big safes are extremely heavy and therefore hard to transport and install. The logistics associated with the manufacturer, handling, transporting, etc. of safes or like protective structures becomes burdensome. For practical applications which require an even bigger secure storage space, construction of vaults or secure rooms becomes the only option. In many cases these construction projects are expensive, lengthy and require special personnel and conditions under which installation and/or construction may be accomplished.

In order to overcome problems and disadvantages of the type set forth above there is need for a vault, safe, or like protective structure, which is designed and structured to be modular. Such a modular construction would preferably comprise a modular vault assembly comprising a plurality of vault modules which are variable in number through the interconnection of additional vault modules to one another. In addition, an improved and proposed modular vault assembly may include each of a possible plurality of vault modules including a plurality of panels or like structure which may be armored or otherwise constructed to resist access to the interior storage area by unauthorized personnel. Moreover, the plurality of panels or like structural components used to construct different ones of the vault modules may be designed, dimensioned and configured to be interconnected such that the plurality of vault modules are disposed in immediately adjacent and in some circumstances accessible relation to one another.

However, construction of a plurality of interconnected, successively adjacently disposed vault modules should also include additional safety features such as being structured to protect the joints, seams or interfacing portions of such interconnected vault modules. It is commonly recognized that such joints, seams and like interfacing portions of a vault are frequently the most vulnerable or weakest area of the vault. As a result, unauthorized entry is frequently attempted by attacking such areas using a variety of different penetrating tools, machinery, etc. It should therefore be a feature of an improved and proposed modular vault assembly to include structural features which protect such seams, joints and/or interfacing portions in order to prevent or at least significantly restrict access to interior storage areas of modular vault assemblies at these more vulnerable locations. Other areas of concern which should be addressed by an improved modular vault assembly relates to the closing, locking, accessing and controlling the operative position and status of multiple doors, each of which may be associated with a different one of a plurality of vault modules.

Therefore, as indicated a simple and practical solution for the secure storage for a large volume of different types of goods is a modular vault assembly that is built to define a secure storage structure having a plurality of storage areas which may be at least partially segregated but operatively accessible in a predetermined manner. Moreover, the overall structure and design of the operative components associated with and at least partially defining a modular vault assembly should facilitate delivery and transportation of such components to a site or location of use, where the modular vault assembly can be assembled on-site at the selected premises. Also, somewhat similar to modular furniture, the various operative components of a preferred and proposed modular vault assembly can be shipped in boxes, transported in standard commercial vehicles, and be handled by a limited number of installers, without the necessity of specialized equipment or training and in a reasonable amount of time.

SUMMARY OF THE INVENTION

The present invention is directed to a modular vault assembly comprising a plurality of vault modules which may vary in number through the interconnection or the addition of different numbers of such vault modules to one another.

As such, one or more preferred embodiments of the modular vault assembly includes the plurality of vault modules comprising a primary vault and at least one secondary vault. However, in a practical application the plurality of interconnected vault modules may include a plurality of secondary vaults connected to one another in successively adjacent or contiguous relation to one another. Also, in such a successively adjacent array of secondary vaults, a leading or first secondary vault is connected directly and immediately adjacent to the primary vault. As such and as referred to herein the first or leading secondary vault would be the first in the successive, immediately adjacent array of secondary vaults.

As used herein, the term "vault" is meant to be interpreted in a broad and/or generic manner and is meant to include and describe similar safes, armored or protective cabinets or similarly structured protective storage units, which incorporate the distinguishing, inventive structural and operative features of the one or more preferred embodiments of the modular vault assembly of the present invention.

Accordingly, the at least one primary vault includes a master door, wherein the one or more secondary vaults each include slave doors. Both the master door and the one or more slave doors include a locking mechanism preferably defined by an interconnected locking linkage connected to a control unit or structure. As indicated in greater detail herein the control units associated with each of the slave doors may be manually accessible and positionable to dispose the locking mechanism, and more specifically the locking linkage into a locked orientation and an unlocked orientation. In cooperation therewith, the locking mechanism and corresponding locking linkage may include a control unit which is mechanically and/or electrically operated by means of a user interface. Moreover, such a user interface is utilized to establish user authentication of one or more individuals attempting to access the primary vault. Such a user interface may be operated and/or activated by a biometric input such as a fingerprint and or iris scanner. In the alternative, such an indicator unit may require the user input or digital scanning of an alphanumeric code, barcode or the like.

However, upon determination of user authentication, the user interface will activate or operate the control unit associated with the locking mechanism of the master door thereby disposing the corresponding locking linkage into the unlocked orientation. This will allow the master door to open and provide full user access to the interior storage area thereof. As explained in greater detail hereinafter, the structural and operative features associated with the modular vault assembly and in particular with the one or more secondary vaults may then be successively opened or have access provided thereto by means of manual access, successively, to the next adjacent secondary vault, wherein manual access will be accomplished by a user from the preceding primary or secondary vault.

Additional features of one or more embodiments of the present invention include each of the master and slave doors having a sensor assembly which is operative to at least indicate the locked orientation of the corresponding master or slave door with which it is operatively associated. The aforementioned indicator unit is connected to each of the sensor assemblies and, as indicated is operative to indicate a status of each of the master and slave doors, at least in terms of the respective locking mechanisms being in a locked orientation or an unlocked orientation. Additional features of the indicator unit may also provide a clear indication and/or display as to whether the respective master and slave doors are in an open orientation or a closed orientation. Moreover, in order to keep one or more users efficiently informed of the status of each of the master and slave doors, the indicator unit may include a visual display which may have audible indicators or alarms. Such display is preferably mounted on a visually accessible position on the master door associated with the primary vault.

Additional structural features of each of the vault modules including both the primary vault and the one or more secondary vaults include an access restricting construction or structure. This comprises at least a rear panel, a top panel, a bottom or floor panel and oppositely disposed side panels. Each of these panels are formed from an access restricting material such as an armored material or other material which is resistant to penetration by the tools or machinery of one or more unauthorized individuals attempting to obtain access to the interior storage area of the various vault modules. Also, in order to more effectively protect the interior storage area, the aforementioned access restricting panels are collectively disposed in substantially surrounding relation to the interior storage area and thereby at least partially define the interior boundaries thereof.

In addition to the plurality of access restricting panels, each of the vault modules, including both the primary vault and the one or more secondary vaults, includes a doorframe integrated into the construction of each panel to the extent of substantially surrounding the outer periphery of each of the master and slave doors. Further, the aforementioned locking linkage is cooperatively disposed with the integrated doorframes so as to interact in locking engagement therewith, when the mechanical linkage is disposed in the aforementioned locked orientation.

Therefore, operation and use of the modular vault assembly of the present invention includes an initial access to the primary vault through the unlocking of the mechanical linkage associated there with and the positioning thereof in an open orientation. This is accomplished by user authentication of the user interface unit, as set forth above. Subsequent to the opening of the master door and acquired access to the interior storage area thereof, a user may manually access the control unit and linkage assembly of the next adjacent secondary vault, referred to a herein as the first or leading vault in the successive array of adjacently interconnected secondary vaults. This is accomplished by passing at least the hand of a user, through the interior of the primary vault and into the interior of the secondary vault for the manual access and operation of the control unit of the locking linkage. Such manual access and manipulation will therefore accomplish the positioning of the locking linkage of the first, leading or immediately next adjacent secondary vault into the unlocked orientation. As a result the slave door of this first or leading, next adjacent secondary vault will be open, thereby providing full physical access of a user to the interior thereof. Once the first or leading secondary vault is opened and accessed, the user may then open the next adjacent, successive secondary vault by manually accessing through insertion of his hand, arm etc. into the interior of the next successively adjacent secondary chamber to manually manipulate the control unit thereof.

By virtue of the above noted operative features, each of the successively adjacent secondary vaults may be successively accessed and opened. Further, in order to provide efficient and accurate communication to an authorized user, the aforementioned sensor assemblies associated with each of the locking mechanisms of each of the master and slave doors will provide an indication, through the visual display (LEDs), audible signals, etc. that each of the locking mechanisms of each of the master and slave doors are or are not in a locked orientation. Such an indicated status is beneficial due to the fact that the previously open master and or slave doors may be in a closed orientation but not locked. By viewing the indicator unit and associated display one or more authorized users will be able to tell in fact which doors are closed but unlocked and which doors are closed but locked. Further, the locking of the previously opened master and slave doors can only be accomplished when all of the doors are in a closed orientation and action has been taken to substantially concurrently dispose the plurality of locking mechanisms in the locked orientation. Such may be accomplished by an exteriorly accessible handle or activating structure mounted on the exterior of the master door associated with the primary vault.

As set forth herein the modular vault assembly of the present invention is sufficiently versatile from a structural standpoint to retain and store a variety of items including larger items such as computers, tablets, projectors, laboratory equipment, files, etc. In order to facilitate such storage while also effectively providing access to these categories of stored items, they may be at least temporarily located on or within a mobile cart, such as a rolling or wheeled cart. Accordingly, the present invention includes one or more embodiments comprising at least one cart vault which is dimensioned, configured and overall structured to accommodate the receipt and storage of such a mobile cart therein. Moreover, distinguishing structural features associated with such a cart vault which differentiate it from a conventional safe, vault, etc. is the positioning and structuring of the interior supporting floor of the cart vault in a substantially level orientation with an exterior supporting surface disposed immediately adjacent the entrance/door of the cart vault. Such a substantially level orientation will eliminate any dangers, inconveniences and more effectively facilitate entrance and withdrawal of the mobile cart from the interior of the cart vault.

As also explained in greater detail, the term "substantially level" is meant to define and describe that the levels between the interior floor of the cart vault and the exterior, immediately adjacent supporting surface would be the same or equal. However, in certain structural modifications where in the cart vault includes an interior floor which includes a protective armored panel or plate, the term "substantially level" may include a slight elevation of the interior floor of the cart vault to the extent of a few millimeters. Such a minor difference in the minimally raised position of the interior floor would not provide any obstructing obstacle to the entry and removal of the rolling cart relative to the interior of the cart vault.

As also emphasized herein, security features of the modular vault assembly of the present invention include the covering or otherwise protecting of all joints, seams, junctions, interfaces, etc. between adjacently disposed and connected modular vaults. To this extent, the one or more cart vaults includes a somewhat enlarged or modified door preferably including a protective, deep pending skirt located at a bottom portion thereof. Such skirt may be integrally or otherwise fixedly secured to the door of the cart vault and be dimensioned, disposed and configured to cover or overlie an exterior periphery of the interior floor of the cart vault and any open areas associated there with.

It is further noted that as a practical matter, the cart vault may comprise one of the aforementioned plurality of secondary vaults. However the structural features of one or more embodiments of the cart vault could also be included or integrated in the structure of the primary vault.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
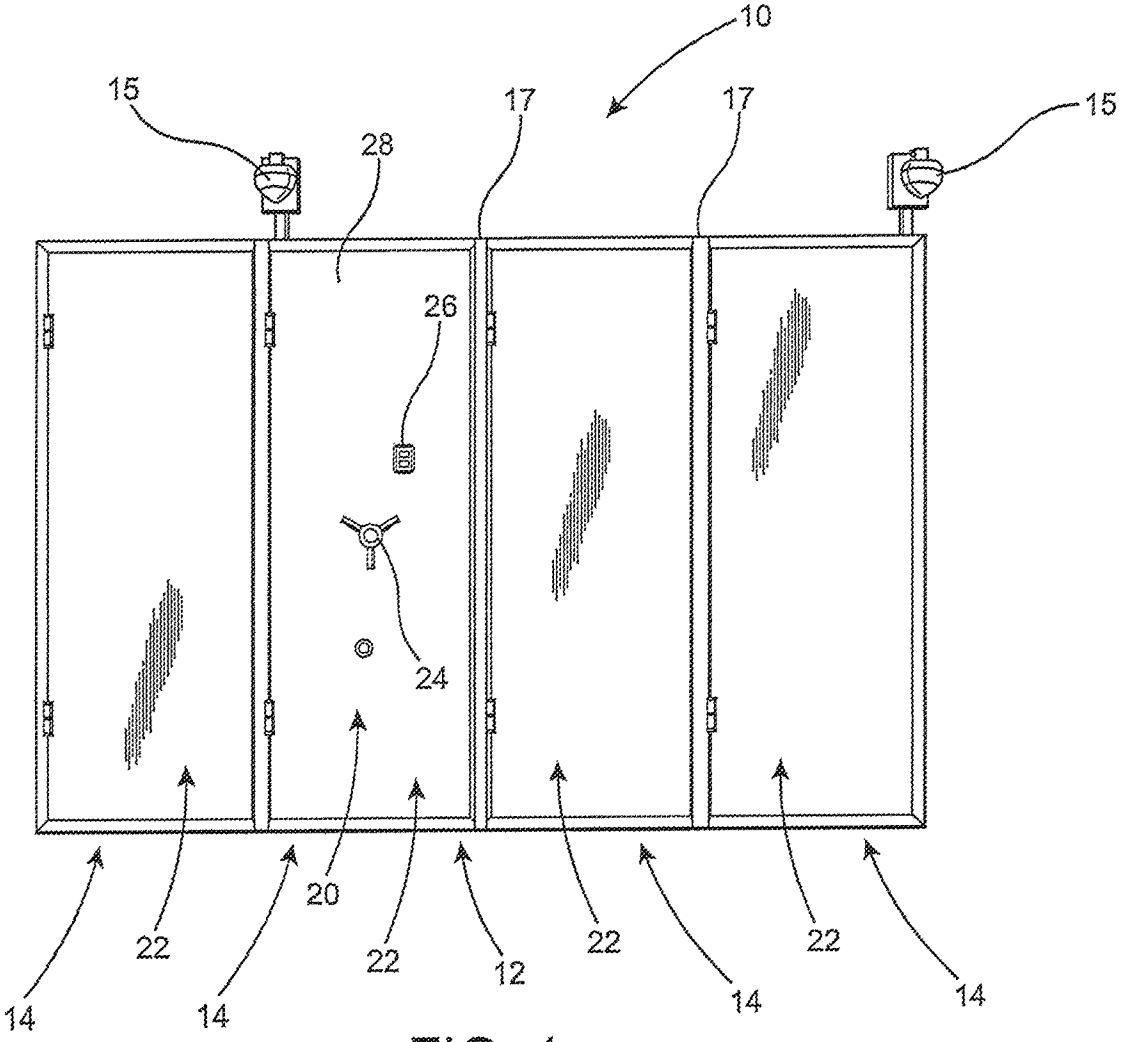
FIG. 1 is a perspective view of the modular vault assembly of the present invention.
Figure 2:
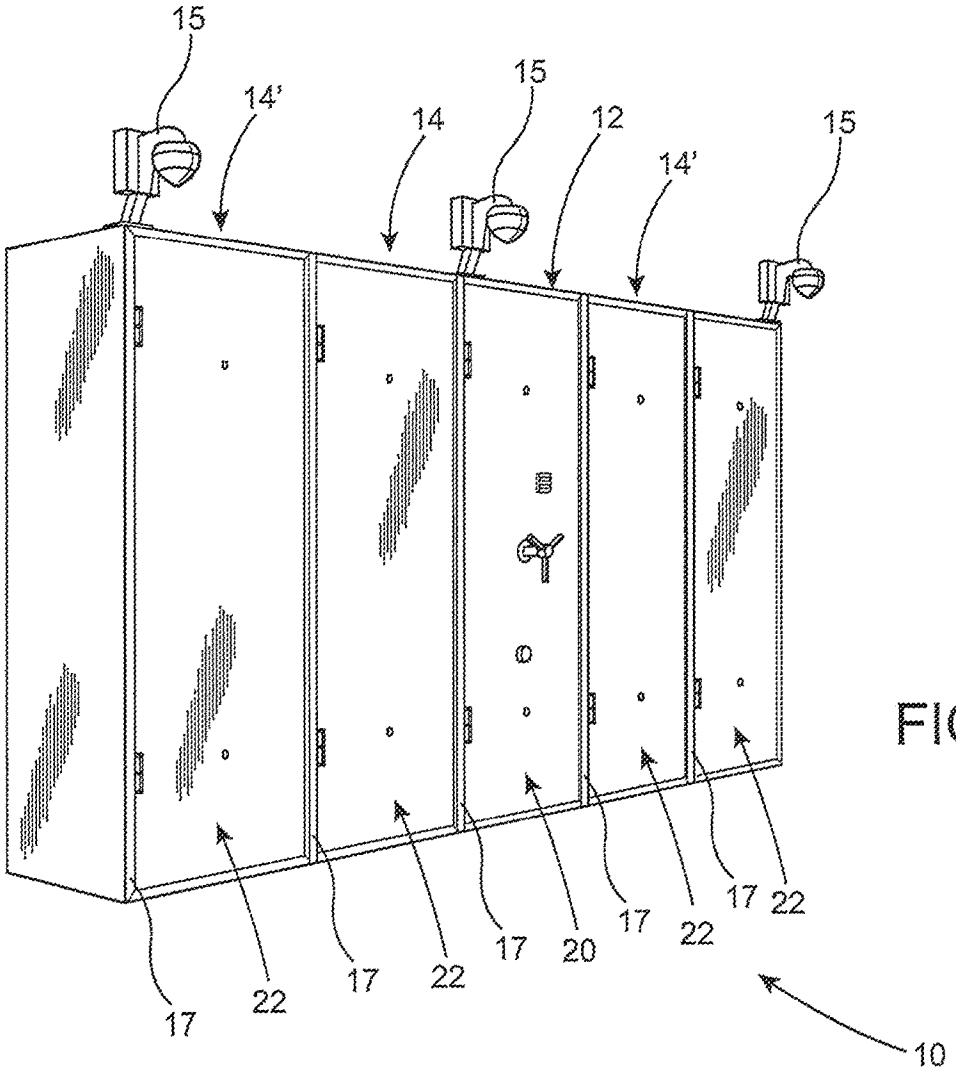
FIG. 2 is a perspective view of the embodiment of FIG. 1 wherein the modular vault assembly of the present invention comprises a variable number of vault modules.
Figure 3:
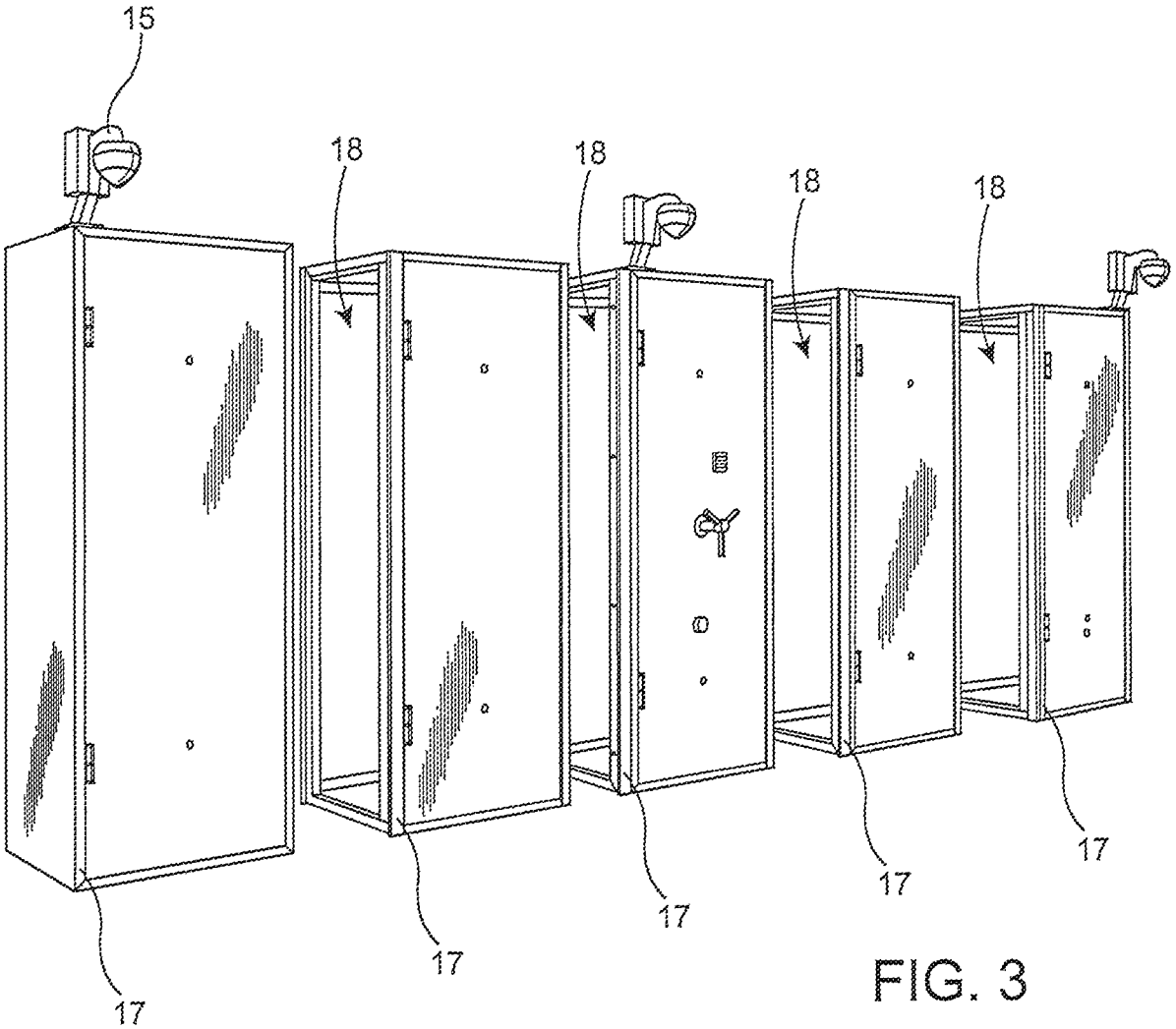
FIG. 3 is a perspective view in exploded form of the embodiment of FIGS. 1 and 2 wherein a plurality of vault modules are unassembled but in a cooperatively disposed position for interconnection.

As represented in the accompanying drawings, the present invention is directed to a modular vault assembly generally indicated as 10 in at least FIGS. 1-3. The modular vault assembly 10 comprises a plurality of vault modules which may vary in number by adding, through interconnection to one another, different numbers of the vault modules. By way of example, and with primary reference to FIGS. 1 and 2 the plurality of vault modules include at least a primary vault 12 and one or more secondary vaults, each indicated as 14. As also represented interconnection of the plurality of vault modules, including the primary vault 12 and the one or more secondary vaults 14 is in a continuously successive array, wherein the plurality of vault modules are arranged in immediately adjacent and or contiguous relation to one another.

A comparison of the modular vault assemblies 10 as represented in FIGS. 1 and 2 indicates that the primary vault module 12 may be accompanied by different numbers of secondary vault modules 14. Further the primary vault module 12 may be located at different positions, such that one or more secondary vault modules 14 may be disposed on opposite sides of the primary vault module 12. Also, modular vault assembly 10 includes a plurality of secondary modules 14, at least some of which may be successively interconnected in immediately adjacent and/or contiguous relation to one another.

It is recognized in the vault and/or safe industry that potentially vulnerable areas of such protective structures may include the joints, seams, junctions, interfaces, etc. between connected ones of the compartments or vault modules. Therefore, in order to protect such potentially vulnerable areas, each of the primary module 12 and one or more secondary modules 14 are structured to include protective features such as side frames 17 which overlie, cover or substantially minimize any exposure of such areas or locations of interconnection including, but not limited to, the aforementioned joints, junctions, interfaces, etc. As also represented throughout the Figures, one or more security cameras 15 may be strategically located on or in an observing relation to the modular vault assembly 10.

Figure 4:
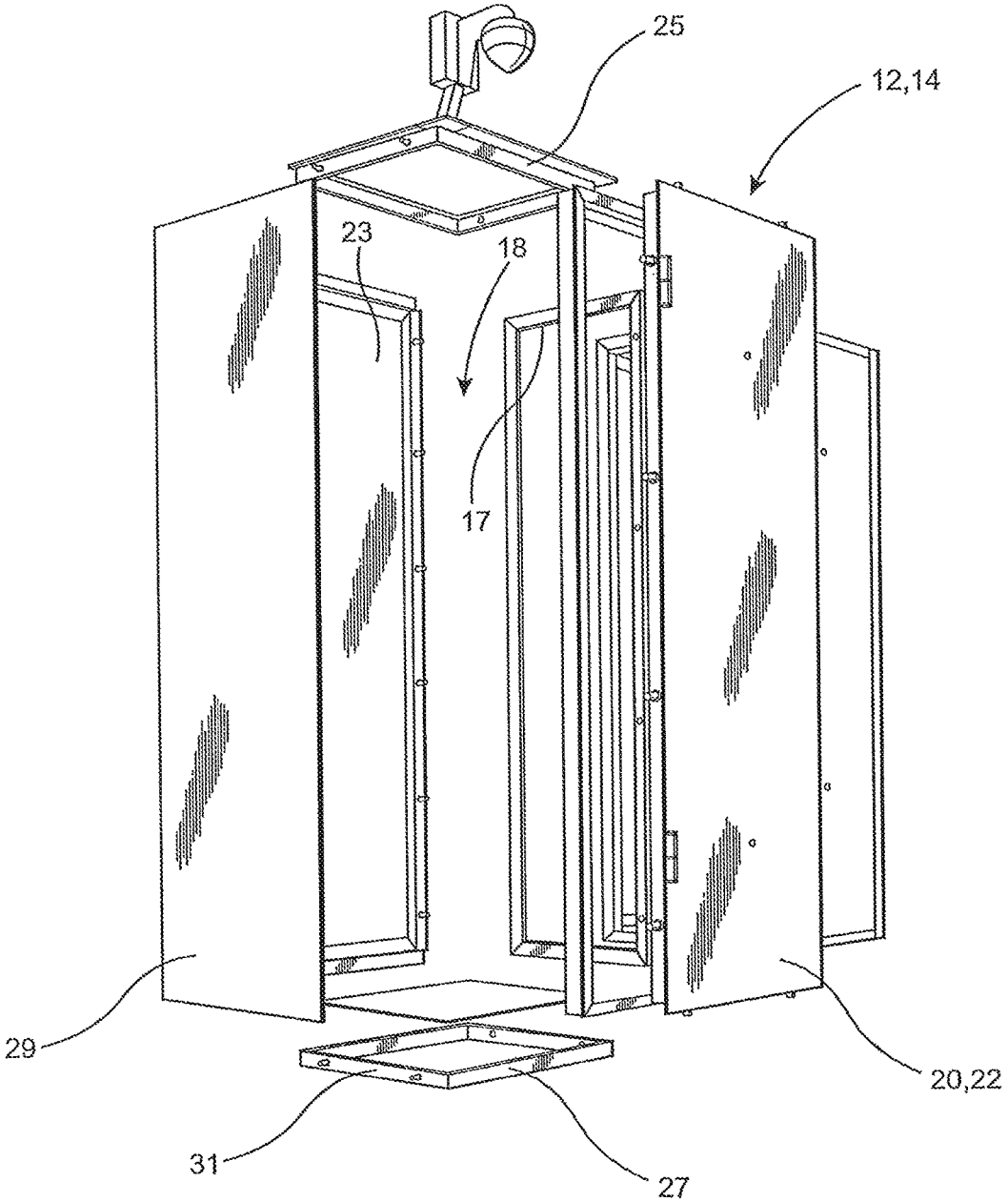
FIG. 4 is a perspective view in exploded form of the various operative components of each of the vault modules which may be interconnected to form the modular vault assembly of the embodiment of FIGS. 1-3.
Figure 8:
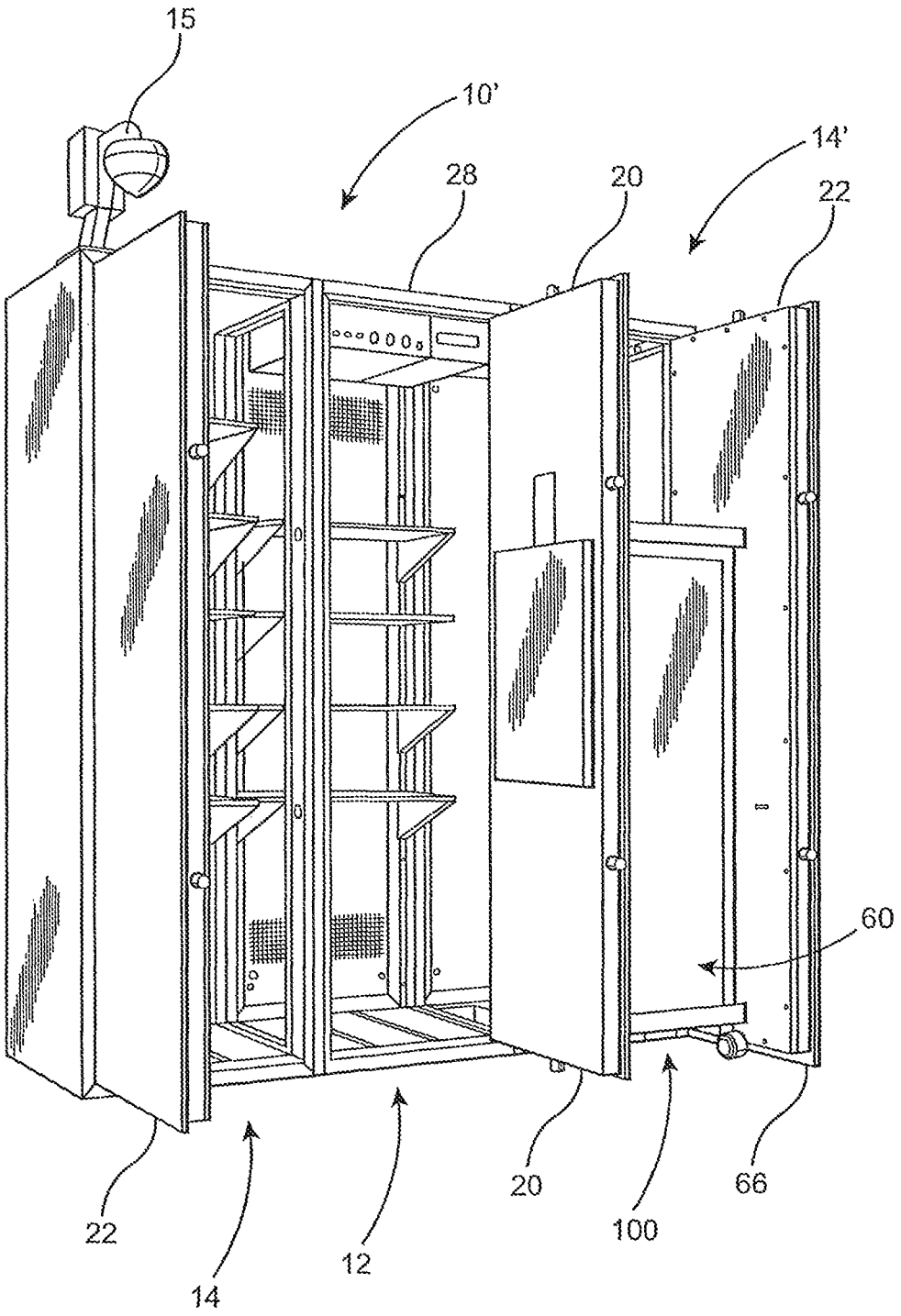
FIG. 8 is a perspective view of another preferred embodiment of the modular vault assembly of the present invention.

In addition, each of the vault modules, including each of the primary vault 12 and one or more secondary vaults 14 include doors which provide full body access to the interior storage areas 18 as represented in at least FIGS. 3 and 4. More specifically, the at least one primary vault 12 includes a "master door" 20 and each of the one or more secondary vaults 14 includes a "slave door" 22. Each of the master and slave doors 20 and 22 may be pivotally connected to corresponding ones of the primary vault 12 and one or more secondary vaults 14 by appropriate hinge structures. As such each of the doors 20 and 22 may be selectively disposed between the closed orientation, as represented in FIGS. 1-3 and an open orientation, as represented in the embodiment of FIG. 8, to be discussed in greater detail hereinafter. Further, when in the open orientation, a user is permitted full physical access to the interior storage area 18, assuming that the interconnected vault modules are sufficiently dimensioned to allow entry of an authorized user to the interior storage area 18.

With further regard to at least FIG. 1, the primary vault 12 and the master door 20 associated therewith may be structured to include and an exterior handle or like structure 24 as well as a user authentication unit 26 disposed on an exterior frontal surface of the master door 20. Also, an indicator unit 28 may be mounted in a visual observable location on the exterior of the master door 20. In the alternative, such an indicator unit 28 may be mounted at least partially on the interior of the primary vault 12 as represented in FIG. 8. The structural and operative features of these units/components will be described in greater detail hereinafter.

With primary reference to FIG. 4, each of the plurality of vault modules, including both the primary vault 12 and one or more secondary vaults 14 include a plurality of panels or like components. The component panels may be formed from an access or penetration resistant material such as a metallic, composite or other appropriate materials which resists penetration or breakage by conventional or customized tools or machinery which may be used by unauthorized personnel to gain access thereto. More specifically, each of the primary vault 12 and one or more secondary vaults 14 comprise a door 20, 22; a rear panel 23; a top or roof panel 25; a bottom or floor panel 27 and oppositely disposed side panels 29. All of the indicated vault panels 23, 25, 27 and 29, as well as the respective doors 20 and 22 are interconnected to one another in the manner indicated so as to at least partially define and determine the interior boundaries of the interior storage area 18, as also at least partially represented in FIG. 3.

Figure 4A:
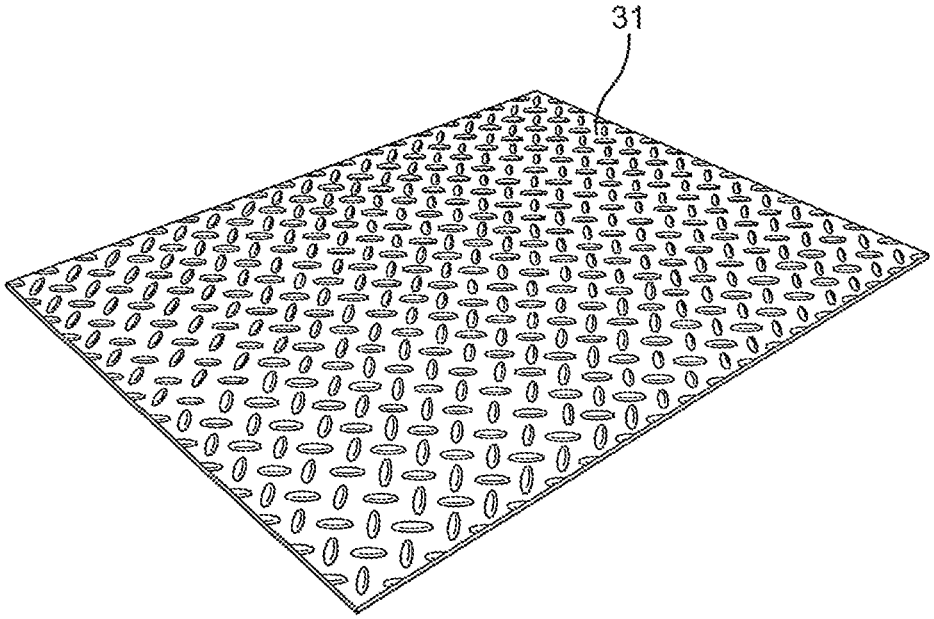
FIG. 4A is a perspective view in detail of a portion of a panel and/or reinforced plate which may define a portion of one or more of the operative components as represented in FIG. 4.

Further with regard to FIG. 4A, the aforementioned access or penetration resistant material may be in the form of metallic or other appropriate material plates 31, which overlie the aforementioned vault panels or which are integrated therein. The protective panels 31 may therefore be considered "armored", wherein FIG. 4A represents an armored or otherwise protective floor plate or panel 31.

Figure 5:
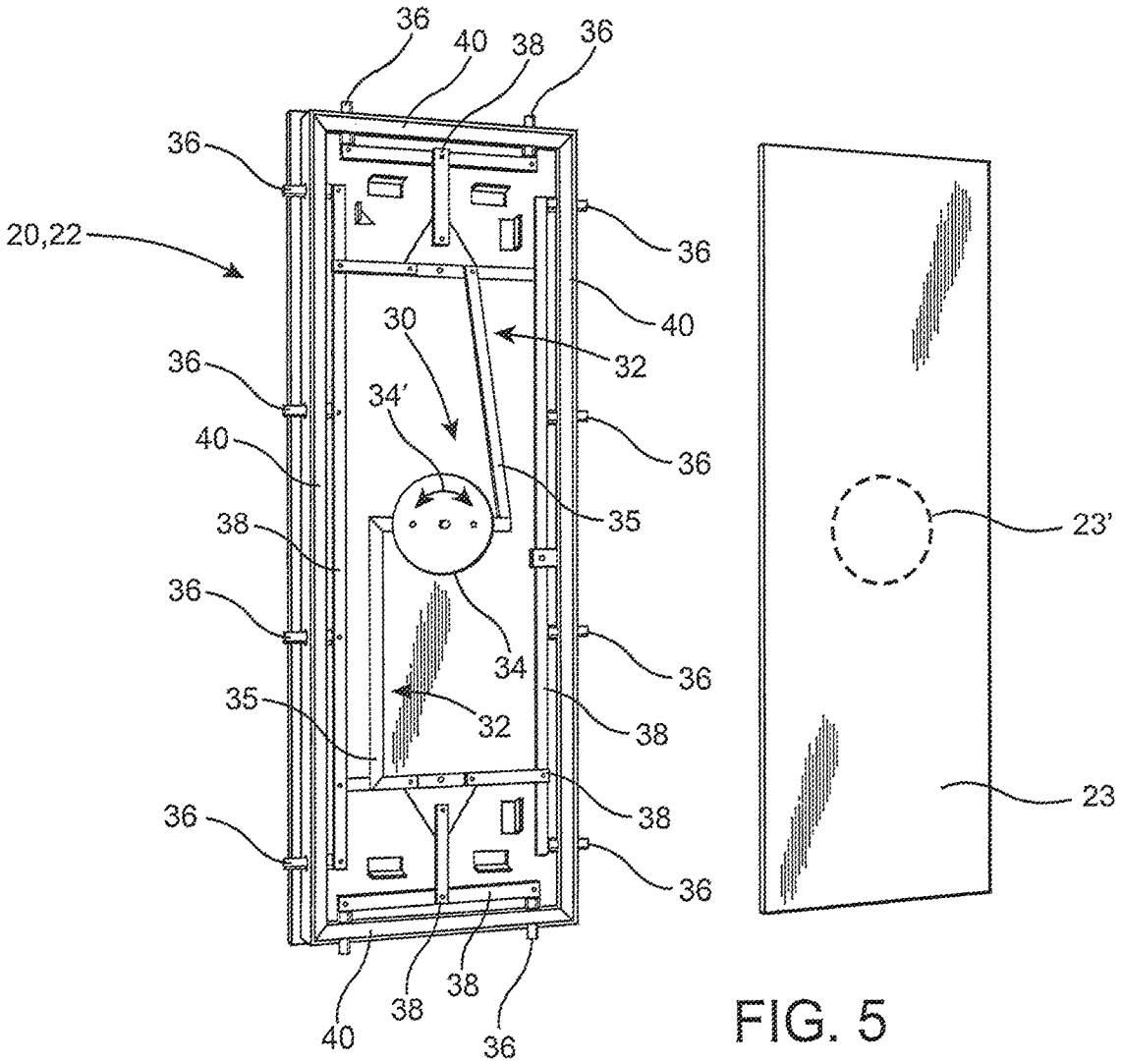
FIG. 5 is a perspective view in exploded form of a locking mechanism, including locking linkage associated with each of the doors of the vault modules of the modular vault assembly as represented in at least FIG. 1-3.
Figure 6:
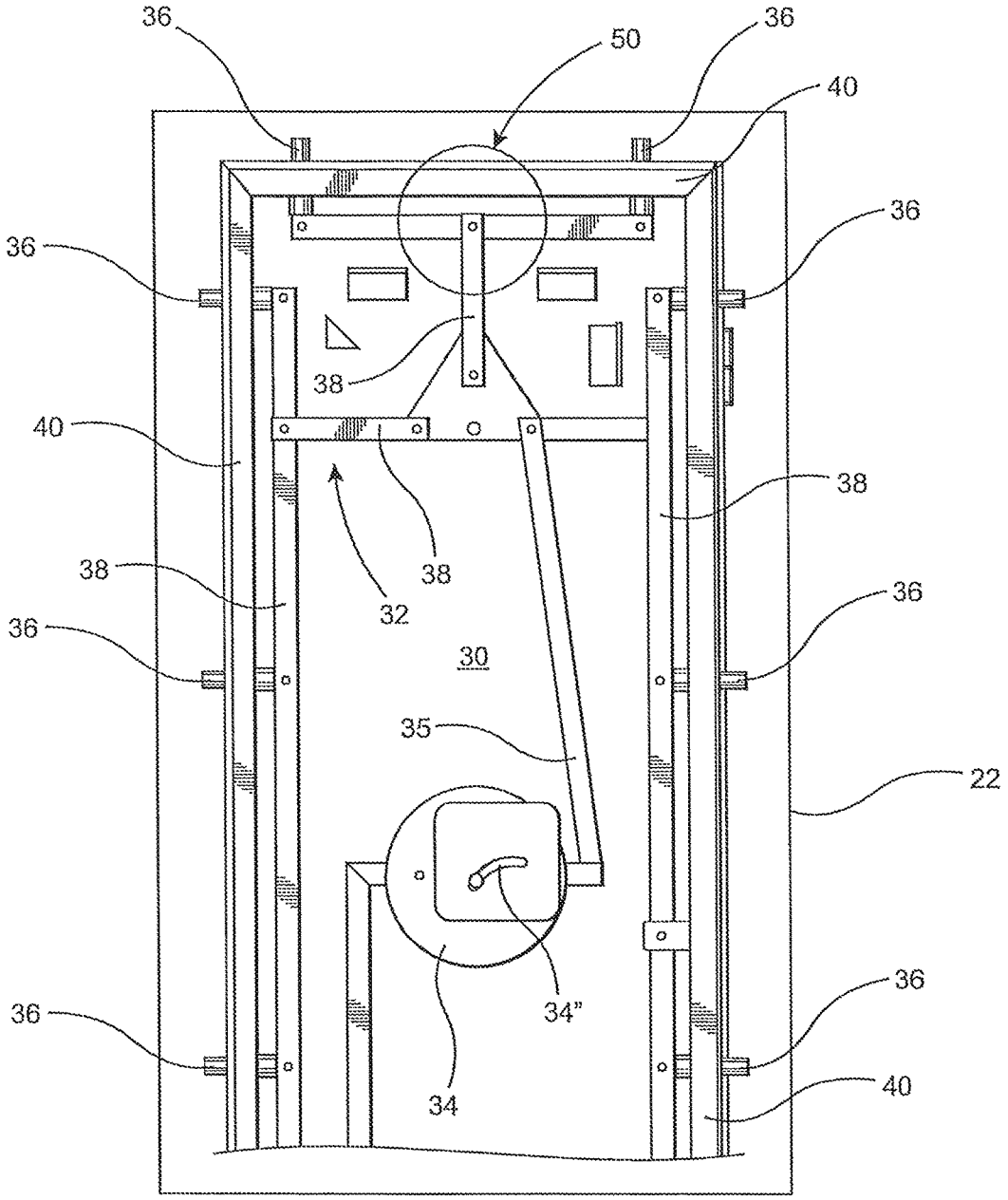
FIG. 6 is an elevational view in partial cutaway of the locking mechanism and associated locking linkage of the embodiment of FIG. 5.
Figure 7:
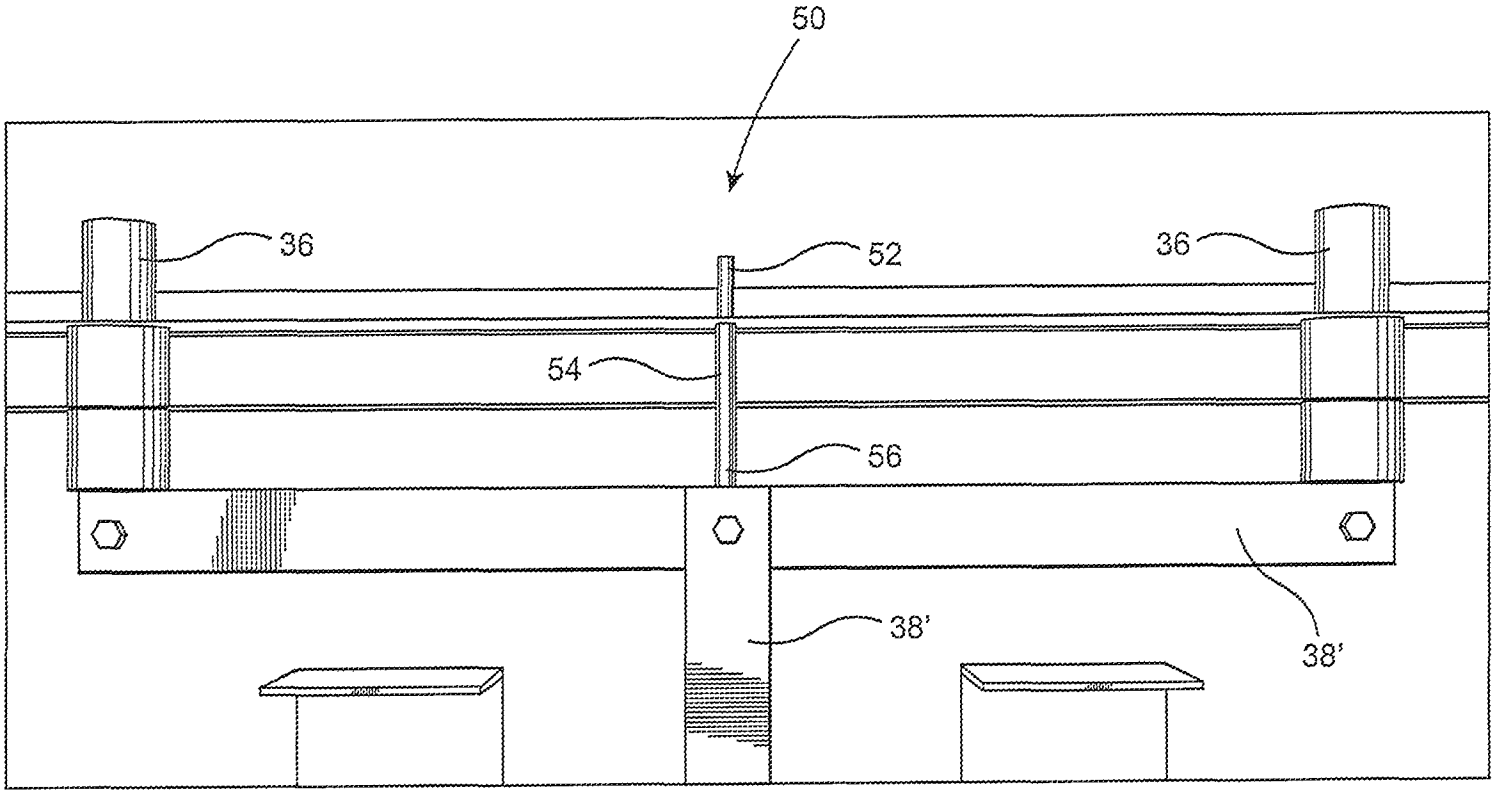
FIG. 7 is a perspective detail view of a sensor assembly operatively associated with the locking mechanism as represented in FIG. 6.

As represented in at least FIG. 5, each of the master and slave doors 20, 22 include a locking mechanism generally indicated as 30. The locking mechanisms 30 includes a locking linkage 32 activated or operated by a control unit 34. Operation or positioning of the control unit 34, such as rotation thereof 34', serves to move the various arms 35 and the interconnected links 37 of the locking linkage 32 into an out of a locked orientation, as represented in FIGS. 5-7 or out of the locked orientation, into an unlocked orientation. Moreover, the structural features and components of the locking linkage 32, as represented, includes a plurality of locking bolts 36 each of which connected to the plurality of links 38 collectively disposed about the periphery of the doorframe 40. The doorframe 40 is integrated into the construction of each of the primary and secondary vaults 12 and 14. Also, the plurality of locking bolts 36 and the integrated doorframe 40 are cooperatively disposed and structured to define a locking interaction of the plurality of bolts 36 with the integrated doorframe 40, when the locking mechanism 30 and locking linkage 32 is in the aforementioned locked orientation. As should be apparent, the unlocked orientation of the locking mechanisms 30 is at least partially defined by each of the plurality of locking bolts 36 being disposed out of the locking interaction with the integrated doorframe 40.

Additional structural features of each of the locking mechanisms 30 include the locking linkage 32 associated therewith being disposed and structured on an interior of the plurality of master and slave doors 20, 22. Further a cover 23 may be disposed in overlying relation to the interior of the doors 20, 22. As will also be explained in greater detail hereinafter, an access opening 23' may be associated with at least the cover panels 23 associated with the slave doors 22 so as to provide manual access to a corresponding control unit 34.

With primary reference to FIGS. 6 and 7, each of the master and slave doors 20 and 22 also include a sensor assembly generally indicated as 50. The sensor assembly 50, may include an operated or activated sensor or other types of sensors such as pressure sensor. Therefore, the sensor assembly 50 may include a sensor unit 52 connected to or disposed in direct interaction with at least a portion of the locking linkage 32, such as at locking links 38' as indicated in both FIGS. 6 and 7. Moreover, when the locking linkage 38, 38' are disposed in the locked orientation, the sensor unit as at 52 will detect the movement of a magnet member 56 into an appropriate location and/or proximity and be detected by the sensor unit 52. The sensor assembly 50 will thereby determine the status of the locking mechanism 30 being in the locked orientation. As also represented, movement of the magnet member 56 will pass it through a guide sleeve or pin 54 as it moves with the links 38'. Therefore, movement of the plurality of bolts 36 into the locked orientation, such as with interlocking relation with the integrated doorframe 40, will concurrently move the magnet 56 into proximity to be sensed by the magnetic sensor unit 52.

Further, the sensor assembly 50, associated with each of the master and slave doors 20 and 22 are interconnected to one another and to the indicator unit 28 as set forth above. As represented, the indicator unit 28 may be mounted in an observable location on the exterior of the master door 20 or alternatively on an interior portion of the primary vault 12, as represented in FIG. 8. In yet another embodiment of the present invention, each of the plurality of sensor assemblies 50 may be interconnected to a remote and or central display panel for observation by a third-party. In addition, each of the indicator units 28 may include a visual display such as a plurality of color-coded LEDs. Alternatively and/or in combination there with, the indicator units 28 may be structured to generate sound signals or alarms which indicate the status of each of the doors 20, 22 and the associated locking mechanisms 30 being in either the locked orientation or the unlocked orientation, as described above.

Therefore, as indicated throughout the Figures, at least some of the doors, including the slave doors 22 do not have an exterior handle or like structure. As a result, a user accessing one or more of the plurality of vault modules and/or secondary vaults 22 will not know whether all of the closed doors 20, 22 are in the locked or unlocked orientation. However, the indicator unit 28 will provide either a visual or audible signal (or both) as to whether the closed doors 20, 22 are locked or unlocked, when they are closed, by providing the appropriate or predetermined visual or audible signal. It is again emphasized that each of the doors 20, 22 may in fact be closed but not be in the locked orientation. Also, all of the locking mechanisms 30 of the doors 20, 22 will only assume the locked orientation when all of the doors 20, 22 are in a closed orientation.

Operation and use of the modular vault assembly 10 of the present invention includes an initial access to the primary vault 12 through the unlocking of the mechanical linkage 30 associated with the master door 20 and the positioning of the master door 20 in an open orientation. This is accomplished by user authentication by the user interface unit 26, as set forth above. The interface unit 26 may be structured for biometric scanning, digital code scanning or direct digital input of a predetermined authorization code. Upon entry or scanning by the interface unit 26, a user is authenticated. This in turn results in the control unit 34 on the interior of the master door 22 positioning the locking mechanism 30 and locking linkage 32 to be automatically (electrically/mechanically) out of the locked orientation and into the unlocked orientation. Thereafter a pulling or other appropriate force being exerted on the external handle 24 will serve to move the master door 20 into the open orientation. However, the mere physical manipulation of the handle itself, without user authentication by the interface unit 26, will not serve to dispose the lock mechanisms 30 of the master door 12 in the unlocked orientation.

Subsequent to the opening of the master door 20 and acquired access to the interior storage area 18 thereof, a user may manually access the control unit 34 of the next adjacent secondary vault, referred to a herein and represented in at least FIG. 2 as 14'. Therefore, the first or leading vault 14' in the successive array of adjacently interconnected secondary vaults 14 is designated as the next one or more secondary vaults 14 connected immediately adjacent or contiguous to the primary vault 12. Moreover, manual access to the interior of the first or leading secondary vault 14' may occur by passing a hand or arm through an adjoining side panel 29 and into the interior of the first or leading secondary vault 14' and through the access opening 23', as represented and described with reference to FIG. 5. Therefore, manual access of at least the hand of a user from the interior 18 of the primary vault 12, into the interior 18 of the first or leading secondary vault 14' and through the access opening 23' accomplishes the manual access to and manipulation/operation of the control unit 34 within the interior 18 of the next adjacent, first or leading secondary vault 14'. Such manual access and manipulation of the appropriate control unit 34 will accomplish the positioning of the locking linkage 32 of the first, leading or immediately next adjacent secondary vault 14' into the unlocked orientation. As a result the slave door 22 of this first or leading, next adjacent secondary vault 14' will be opened, thereby providing full physical access of a user to the interior 18 thereof. Once the first or leading secondary vault 14' is opened and accessed, the user may then pass into the interior 18 of the secondary vault 14' and open the next adjacent, successive secondary vault 14. This is accomplished by manually accessing through insertion of his hand, arm etc. through an adjoining side panel 29 and into the interior 18 of the next successively adjacent secondary chamber 14 and through an access opening 23' to manually manipulate the control unit 34 associated there with.

By virtue of the above noted operative features, each of the successively adjacent secondary vaults 14', 14 may be successively accessed and opened. Further, in order to provide efficient and accurate communication to an authorized user, the aforementioned sensor assemblies 50 associated with each of the locking mechanisms 30 of each of the master and slave doors 20 and 22 will provide an indication, through the visual display (LEDs), audible signals, etc. associated with the indicator unit 28, that each of the locking mechanisms 30 of each of the master and slave doors 20 and 22 are or are not in a locked orientation. Such an indicated status is beneficial due to the fact that the previously open master and or slave doors 20 and 22 may be in a closed orientation but not locked. By viewing the indicator unit 28 and associated display, one or more authorized users will be able to tell in fact which doors 20, 22 are closed but unlocked and which doors 20, 22 are closed but locked. Further, the locking of the previously opened master and slave doors 20, 22 can only be accomplished when all of the doors are in a closed orientation and action has been taken to substantially concurrently dispose the plurality of locking mechanisms 30 in the locked orientation. Such may be accomplished by the exteriorly accessible handle or activating structure 24 mounted on the exterior of the master door 20 associated with the primary vault 12. Moreover, when all of the doors 20, 22 are in a closed orientation and appropriate manipulation of the handle 24 will serve to substantially concurrently dispose all of the locking mechanisms 30 in the locked orientation.

Figure 9:
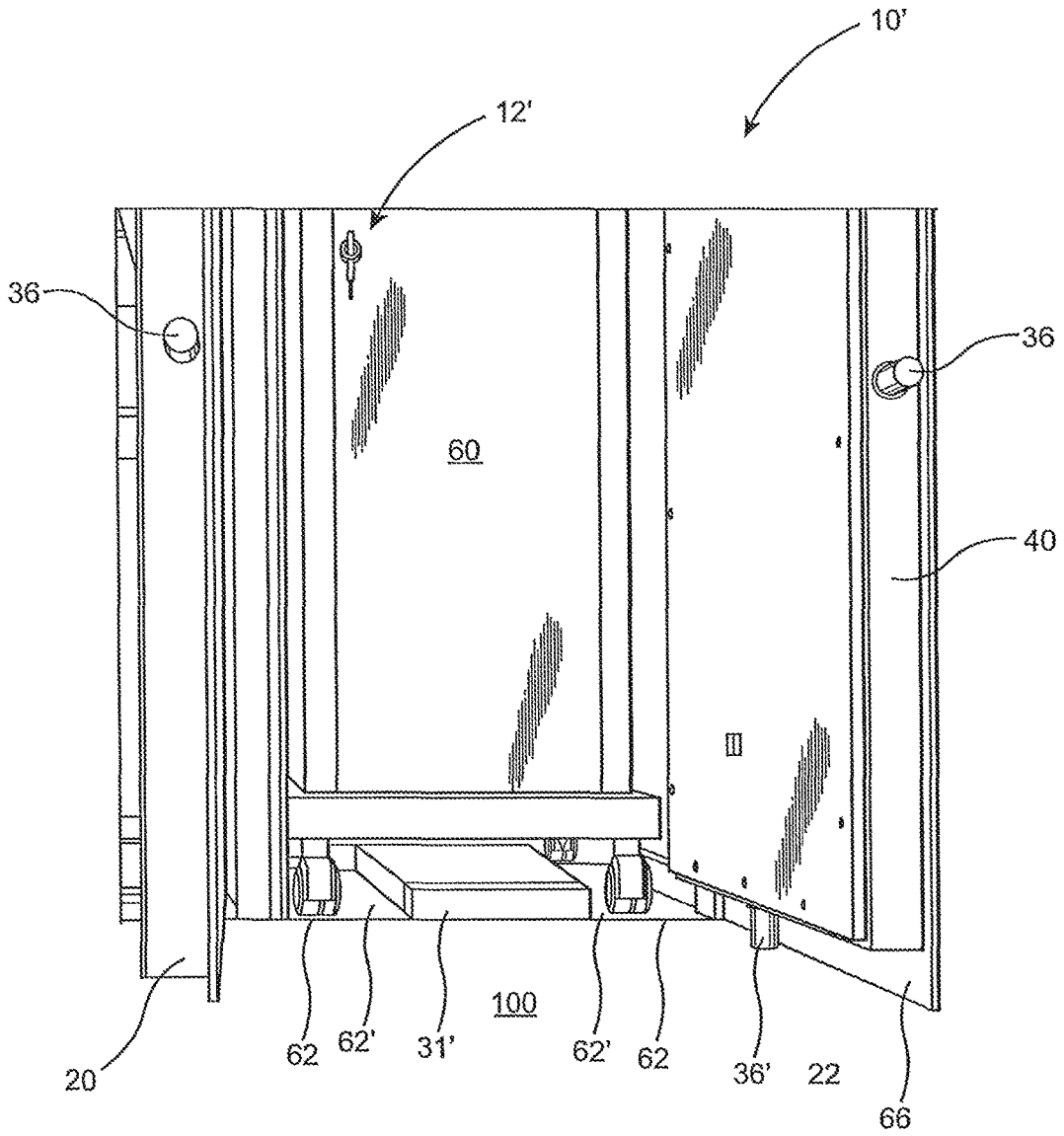
FIG. 9 is a perspective view in partial cutaway representing details of the embodiment of FIG. 8.

As set forth herein the modular vault assembly 10 of the present invention is sufficiently versatile, at least from a structural standpoint, to retain and store a variety of items including larger and/or heavier items such as computers, tablets, projectors, laboratory equipment, files, etc. In order to facilitate such storage, while also effectively providing access to these larger and/or heavier items, they may be at least temporarily located on or within a mobile cart, such as a rolling or wheeled cart. Accordingly, as represented in FIGS. 8 and 9, the present invention includes one or more additional embodiments comprising at least one of cart vault 14' which is dimensioned, configured and overall structured to accommodate the receipt and storage of such a mobile cart 60 therein. Moreover, distinguishing structural features associated with such a cart vault 14' which differentiate it from a conventional safe, vault, etc. is the positioning and structuring of the interior supporting floor 62 of the cart vault 14' in a substantially level orientation relative to an exterior supporting surface 100 disposed immediately adjacent the entrance/door opening of the cart vault 14'. Such a substantially level orientation between the supporting floor 62 and the exterior supporting surface 100 will significant reduce or substantially eliminate any dangers or inconveniences associated with the removal and/or entry of the mobile cart 60 within the interior 18 of the cart vault 14'.

As clearly represented FIG. 9, the interior supporting floor of the cart vault 14' may also include a reinforced armor plate or the like 31' with which the correspondingly disposed bolt 36' may enter actively lock. If such a structure armored floor plate 31' were utilized, the supporting floor 62 would effectively include or be structured to comprise elongated tracks 62' on opposite sides of the armored floor plate 31'. Accordingly, the tracks 62' would assume the aforementioned substantially level orientation with the exterior surface 100.

As also explained in greater detail, the term "substantially level" as used herein with reference to the level or substantially coincident positioning of the interior supporting floor 62 and the exterior supporting surface 100, is meant to define and describe that the levels between the interior floor 62, 62' of the cart vault 14' and the exterior, immediately adjacent supporting surface would be the same or equal. However, in certain structural modifications wherein the cart vault 14' includes the interior floor 62 including the protective armored panel or plate 31', the term "substantially level" may include a slight elevation of a few millimeters of the interior floor 62, 62' of the cart vault 14'. Such a minor difference in the minimally raised position of the interior floor 62, 62' would not provide any significant obstruction to the entry and removal of the rolling cart 60 relative to the interior 18 of the cart vault 14'.

It is also emphasized that in the embodiment of FIGS. 8 and 9, the cart vault 14' is indicated as being a secondary vault. However, the versatility of the structure of the modular vault assembly 10, 10' could include the primary vault 12 being structured as the "cart vault".

As also emphasized herein, security features of the modular vault assembly 10, 10' of the present invention include the covering or otherwise protecting of all joints, seams, junctions, interfaces, etc. between adjacently disposed and connected modular vaults 12, 14, 14'. To this extent, the one or more cart vaults 14' includes a somewhat enlarged or modified door 22, preferably including a protective, depending skirt 66 located at a bottom portion thereof. Such skirt 66 may be integrally or otherwise fixedly secured to the door 22 of the cart vault 14'. Further the protective skirt 66 is preferably dimensioned, disposed and configured to cover or overlie an exterior periphery of the interior floor 62, 62' of the cart vault 14' and any open areas associated therewith.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A modular vault assembly comprising:

a plurality of vault modules variable in number by the interconnection of additional vault modules to one another, said plurality of vault modules including a primary vault and at least one secondary vault, said primary vault including a master door and said at least one secondary vault including a slave door, each of said master and slave doors including a locking mechanism operable to assume a locked orientation and an unlocked orientation, said locking mechanism of said slave door of said secondary vault manually and independently positionable into said unlocked orientation by manual access thereto from an interior of said primary vault, each of said master and slave doors further including a sensor assembly operative to at least indicate said locked orientation of a corresponding one of said locking mechanisms.

2. The modular vault assembly as recited in claim 1 further comprising an indicator unit connected to each of said sensor assemblies and operative to indicate a status of each of said master and slave doors.

3. The modular vault assembly as recited in claim 2 wherein said indicated status comprises each of said locking mechanisms being disposed in said locked orientation or said unlocked orientation.

4. The modular vault assembly as recited in claim 3 wherein said indicated status further comprises each of said master and slave doors being in an open orientation or a closed orientation.

5. The modular vault assembly as recited in claim 3 wherein said indicator unit includes a display mounted on said master door in a visually accessible location.

6. The modular vault assembly as recited in claim 3 wherein each of said sensor assemblies is cooperatively disposed and structured with a corresponding one of said locking mechanisms to determine said indicated status thereof in said locked orientation or said unlocked orientation.

7. The modular vault assembly as recited in claim 1 further comprising a user interface determinative of user authentication and operative with said locking mechanism of said master door for a positioning thereof in at least said unlocked orientation.

8. The modular vault assembly as recited in claim 1 wherein each of said primary vault and said at least one secondary vault include an interior storage area fully accessible through corresponding ones of said master door and slave door.

9. The modular vault assembly as recited in claim 8 wherein each of said primary vault and said at least one secondary vault includes an access restricted structure at least partially surrounding and defining boundaries of said interior storage area.

10. The modular vault assembly as recited in claim 9 wherein said access restricting structure comprises a rear panel, a top panel, a bottom panel and oppositely disposed side panels, each formed of an access restricting material.

11. The modular vault assembly as recited in claim 10 wherein said access restricting material comprises a penetration resistant material.

12. The modular vault assembly as recited in claim 1 wherein each of said locking mechanisms comprise a linkage assembly and a control structure, said control structure connected to said linkage assembly and operative to position said linkage assembly into said locked orientation or said unlocked orientation.

13. The modular vault assembly as recited in claim 12 further comprising a user interface determinative of user authentication and operatively connected to said linkage assembly of said master door; said user interface operative to position said linkage assembly of said master door in said unlocked orientation and said master door in an open orientation, concurrent to determination of said user authentication.

14. The modular vault assembly as recited in claim 13 wherein said control structure and said linkage assembly of said at least one slave door is disposed within an interior of said one secondary vault and in manually accessible disposition from an interior of said primary vault, subsequent to said master door being disposed in an open orientation.

15. The modular vault assembly as recited in claim 14 wherein said linkage assembly of said slave door is disposed and structured for manual disposition in said unlocked orientation, subsequent to disposition of said master door in said open orientation.

16. The modular vault assembly as recited in claim 14 wherein said primary vault and said at least one secondary vault are disposed in adjacent, interconnected relation to one another and each include an interior storage area; said interior storage area of said one primary vault disposed and structured for manual access to said storage area of said one secondary vault.

17. The modular vault assembly as recited in claim 1 wherein said plurality of vault modules further comprises a plurality of secondary vaults disposed in successively adjacent relation to one another; a first of said plurality of secondary vaults disposed in directly adjacent relation to said primary vault.

18. The modular vault assembly as recited in claim 17 wherein each of said secondary vaults comprises an interior storage area fully accessible via a corresponding one of a plurality of slave doors.

19. The modular vault assembly as recited in claim 17 wherein said primary vault and each of said plurality of secondary vaults comprise an integrated frame disposed in surrounding relation to corresponding ones of said master door and said slave doors, said locked orientation comprising each of said locking mechanisms disposed in locking interaction with corresponding ones of said doorframes.

20. The modular vault assembly as recited in claim 19 wherein each of said plurality of slave doors includes a locking mechanism disposable in said locked orientation and said unlocked orientation; said locking mechanism of said slave door of said first secondary vault manually accessible from an interior storage area of said primary vault; each of said locking mechanisms of the remainder of said plurality of slave doors manually accessible, successively, from said interior storage area of a preceding, next adjacent one of said plurality of secondary vaults.

21. The modular vault assembly as recited in claim 1 further comprising a cart vault including an interior dimensioned to removably store a mobile cart therein; said cart vault including an internal floor disposed in substantially level relation to an adjacent support surface exteriorly of said cart vault.

22. The modular vault assembly as recited in claim 21 wherein said cart vault comprises an enlarged door having a depending skirt disposed along a lower portion thereof and in covering relation to a frontal portion of said internal floor.

23. The modular vault assembly as recited in claim 21 wherein said cart vault comprises said primary vault or one of said plurality of secondary vaults.

24. A modular vault assembly comprising:

a plurality of vault modules including a primary vault and a plurality of secondary vaults, said plurality of vault modules variable in number by an interconnection of additional vault modules, at least to said plurality of secondary vaults, said plurality of secondary vaults connected to one another in successively adjacent relation and a leading secondary vault connected directly adjacent to said primary vault, said primary vault including a master door and each of said secondary vaults including a slave door, each of said slave doors and said master door including a locking mechanism disposable in a locked orientation and an unlocked orientation, said locking mechanism of said slave door of said leading secondary vault accessible for independent disposition in said unlocked orientation, from an interior of said primary vault, each of said locking mechanisms of said slave doors of a remainder of said secondary vaults being successively accessible for independent disposition in said unlocked orientation, from an interior of a preceding, next adjacent one of said plurality of secondary vaults, each of said secondary vaults comprising an interior storage area fully accessible via a corresponding one of a plurality of slave doors.

25. The modular vault assembly as recited in claim 24 further comprising a cart vault including an interior dimensioned to removably store a mobile cart therein; said card vault including an internal floor disposed in substantially level relation to an adjacent support surface exteriorly of said cart vault.

26. The modular vault assembly as recited in claim 24 wherein said locking mechanism of said slave door of said leading secondary vault is manually accessible for disposition in said unlocked orientation, from an interior of said primary vault.

27. The modular vault assembly as recited in claim 26 wherein each of said locking mechanisms of said slave doors of a remainder of said plurality of secondary vaults are successively accessible manually for disposition in said unlocked orientation, from an interior of a preceding, next adjacent one of said plurality of secondary vaults.

28. The modular vault assembly as recited in claim 24 wherein each of said master and slave doors further includes a sensor assembly operative to at least indicate said locked orientation of a corresponding one of said locking mechanisms.

29. The modular vault assembly as recited in claim 28 further comprising and indicator unit connected to each of said sensor assemblies and operative to indicate a status of each of said master and slave doors.

30. The modular vault assembly as recited in claim 29 wherein said indicated status comprises each of said locking mechanisms being disposed in said locked orientation or said unlocked orientation.

31. The modular vault assembly as recited in claim 24 wherein said primary vault and each of said plurality of secondary vaults comprise an integrated frame disposed in surrounding relation to corresponding ones of said master door and said slave doors, said locked orientation comprising each of said locking mechanisms disposed in locking interaction with corresponding ones of said doorframes.

32. The modular vault assembly as recited in claim 31 wherein said primary vault and each of said plurality of secondary vaults comprises a rear panel, a top panel, a bottom panel and oppositely disposed side panels, each formed of a penetration restricting material.

33. A modular vault assembly comprising:

a plurality of vault modules variable in number by the interconnection of additional vault modules to one another, said plurality of vault modules including a primary vault and at least a first secondary vault adjacent to said primary vault, and a second secondary vault adjacent to said first secondary vault, said primary vault including a master door and said first and second secondary vaults each including a slave door, said primary vault and said first and second secondary vaults comprising an interior storage area, each of said master and slave doors including a locking mechanism operable to assume a locked orientation and an unlocked orientation, and said locking mechanism of said slave door manually and independently positionable into said unlocked orientation by manual access thereto from an interior of at least one adjacent vault.

* * * * *